United States Patent [19]

Kleinman et al.

[11] Patent Number: 4,819,258

[45] Date of Patent: Apr. 4, 1989

[54] AUTO-SETTING OF KV IN AN X-RAY MACHINE AFTER SELECTION OF TECHNIC FACTORS

[75] Inventors: Bennett Kleinman, Amityville; Calvin Kleinman; Robert P. Coe, both of Dix Hills, all of N.Y.

[73] Assignee: Bennett X-Ray Corp., Copiague, N.Y.

[21] Appl. No.: 85,457

[22] Filed: Aug. 13, 1987

Related U.S. Application Data

[63] Continuation-in-part of Ser. No. 935,764, Nov. 28, 1986.

[51] Int. Cl.[4] ..... H05G 1/32

[52] U.S. Cl. ..... 378/111; 378/112

[58] Field of Search ..... 378/101, 108, 111, 112

[56] References Cited

U.S. PATENT DOCUMENTS

| | | | |
|---|---|---|---|
| 4,348,590 | 9/1982 | Daniels et al. | 378/112 |
| 4,403,337 | 9/1983 | Kleinman | 378/95 |
| 4,597,094 | 6/1986 | Kleinman | 378/95 |

OTHER PUBLICATIONS 4-page brochure of Bennett X-Ray Corp. entitled "Bennett Auto-Tech System".

*Primary Examiner*—Eugene R. LaRoche
*Assistant Examiner*—David Mis
*Attorney, Agent, or Firm*—Cooper & Dunham

[57] ABSTRACT

An x-ray machine in which an electronic network automatically sets the KV for the power to the x-ray tube, by using a transformer with separate secondary windings which can be selectively included in a series circuit through relays controlled by a binary sequence, in response to operator-selected KV control signal, in a system in which the operator selects the mAs setting and the other technic factors (except KV) are automatically selected.

10 Claims, 4 Drawing Sheets

AUTO-SETTING OF KV IN AN X-RAY MACHINE AFTER SELECTION OF TECHNIC FACTORS

REFERENCE TO RELATED APPLICATION

This application is a continuation-in-part of parent application Ser. No. 935,764 filed Nov. 28, 1986 and entitled X-RAY MACHINE WITH AUTOMATIC SETTING OF A TIMER SELECTOR AND AN mA STATION FOR A SELECTED mAs SETTING, which is hereby incorporated herein in its entirety.

BACKGROUND AND SUMMARY OF THE INVENTION

The invention is in the field of x-ray machines, such as those used for medical diagnostic x-ray imaging. An important aspect pertains to automatically selecting technic factors in response to an operator-selected mAs setting and automatically supplying the x-ray tube with power at a KV selected by an operator setting, in particular by automatically delivering the correct voltage to the primary winding of the HT transformer as a result of a binary sequence selection of a series connection of relay-controlled secondary windings of a power transformer.

A system for automatic selection of technic factors such as KV, mA and exposure time is disclosed in commonly owned U.S. Pat. Nos. 4,597,094 and 4,403,337, the disclosure of which is hereby incorporated by reference as though fully set forth herein. Equipment embodying certain aspects of the inventions disclosed in said patents is commercially available from the common assignee under the tradename Bennett AUTO-TECH System, and can be used in conjunction with x-ray machines available from the same assignee under the designations P-325, CM-425 and P-625. In one system disclosed in said patents and literature on said Auto-Tech System, there is an automatic selection of the technic factors on the basis of (i) an automatic determination of the anatomical thickness (of the body part to be x-rayed) through the use of a non-contact ranging system (such as a sonic or an infrared beam ranging system), (ii) if needed, a push-button identification of the body region to be x-rayed (e.g., skull, thorax, extremity, etc.), and (iii) a push-button selection of the anatomical part (e.g., hand, wrist, forearm, elbow, humerus, tibia, etc.). The result is an automatic selection of KV, mA and mAs for the particular exposure, to thereby ensure consistent high quality images and eliminate the need for the operator to use calipers and refer to technic charts. Such auto-selection is implemented in the equipment identified in the brochure of the assignee entitled "Bennett AUTO-TECH System," which is hereby incorporated by reference herein.

In another system, which is disclosed in said parent application and which forms a part of the invention claimed in this application, the x-ray machine has an otherwise conventional control panel with several discrete timer selections, mA stations and mAs settings. However, unlike conventional control panels, the system also includes a processor responsive to the selection of an mAs setting to automatically select and display the combination of a timer selection and an mA station which best approximates the selected mAs setting. The KV is also automatically selected.

Once the technic factors are selected, it is necessary to ensure that the x-ray tube is operated in accordance with the selection. One prior art way of doing this is to use a transformer with a movable tap on the secondary side, and to manually adjust the tap position in order to deliver power the the x-ray tube at the required KV. One disadvantage of this is the need for manual adjustment and the complications of a movable transformer tap, and the need to have the operator rely on an accurate meter which would show the level of the manually selected KV.

In contrast, this invention in response to an operator-selected KVP setting automatically supplies the x-ray tube with power at the correct KV, by using a transformer which does not have movable taps. The transformer uses a set of secondary windings which can be selectively included in a series circuit (and, if needed, added to or subtracted from line voltage) by respective relays controlled by a binary sequence from a microcomputer. For example, six secondary windings can be used, the first at 1.9V output, the second at 3.8V, the third at 7.6V, etc., assuming nominal line voltage at the primary winding. (In fact, in the preferred embodiment there is a slight deviation from a perfect binary sequence, as the fourth winding is at 15.3 rather than at 15.2V.) Thus, for a line voltage of 220 VAC to the primary winding, any collective secondary voltage in the range of about 90 to 340 VAC can be obtained, in steps of about 1.9 VAC, by adding up the output voltage of secondary windings (and, if needed, by adding or subtracting the result from the 220 VAC line voltage). The resulting collective secondary voltage can be supplied to a second transformer having a fixed turn ratio, whose secondary winding powers the x-ray source at a KV determined by the collective secondary voltage of the first transformer. Provisions are made for calibration to account for variations in the line voltage.

In said earlier patents the technic factors are selected on the basis of an automatic measurement of the anatomical thickness of the body part to be imaged, using for the purpose a ranging transducer relying on a beam of acoustic or light energy. A system relying on such automatic measurement of anatomical thickness for fully automatic selection of technic factors, and on a binary sequence to select a series circuit of relay-controlled secondary windings in the manner disclosed in detail below, was described at a meeting for dealers of the assignee of this application and was on sale in this country in 1986, more than a year before the filing date of this application. However, a system using the binary sequence selection of a series circuit of secondary windings in conjunction with operator selection of an mAs setting and thereafter an automatic selection of other technic factors, as described in detail below, has not been described or placed on sale more than a year before the filing date of this application.

DETAILED DESCRIPTION

Figure 1:
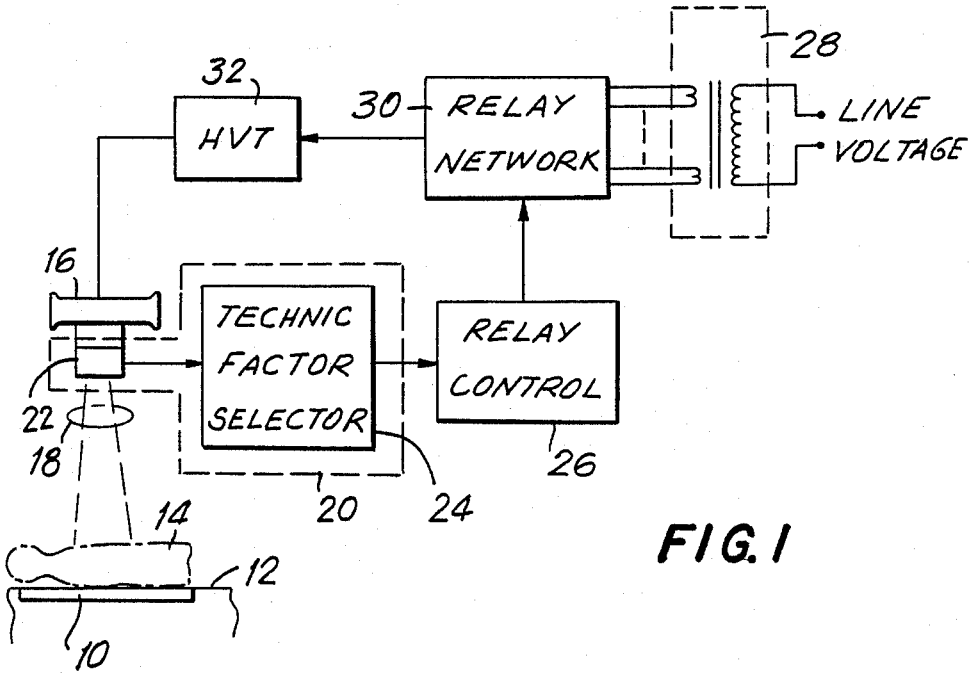
FIG. 1 illustrates main components of an x-ray system using automatic measurement of the anatomical thickness of a body part which is to be x-rayed.

As seen in FIG. 1 an x-ray machine which comprises an image receptor 10, a support 12 for a body 14, and an x-ray source 16 energizable to irradiate image receptor 10 with an x-ray beam 18 during an exposure time interval to thereby form, on image receptor 10, an x-ray image of body 14.

In an example in which the anatomical thickness of body 14 is measured automatically, a unit 20 includes a system 22 which helps automatically measure the anatomical thickness of the part of body 14 which will be imaged and provides a body thickness signal related to the measured thickness. System 22 can be in accordance with said commonly owned U.S. Pat. Nos. 4,403,337 or 4,597,094, in which a transducer at x-ray source 16 directs a ranging beam at the body 14 and detects the reflection thereof from the body. The time difference is related to the distance between x-ray source 16 and the body surface nearest thereto in the path of the ranging beam. As the distance from x-ray source 16 to body support 12 is known, or can be measured in the same way when body 14 is not on support 12, or can be measured manually, and can be stored in thickness measuring system 22, the difference between these two distances is a measure of the thickness of the part of body 14 which will be irradiated and imaged during the exposure interval. As disclosed in said commonly owned patents, and as used in the equipment identified in the brochure which is incorporated by reference, thickness measuring system 22 provides an electrical signal (analog or digital) indicative of the relevant body thickness.

In this example a technic factor selector 24 selects technic factors for the forthcoming exposure on the basis of the body thickness signal provided from thickness measuring system 22 as well as on the basis of manual entries made by an operator. Technic factor selector 24 also can be in accordance with said commonly owned patents, and in accordance with the system available from the assignee under the tradename Bennett AUTO-TECH System. Briefly, the operator uses pushbuttons to select certain parameters relevant to the forthcoming exposure, such as the body region to be exposed (skull, chest, etc.) and, if applicable, the anatomical part to be exposed (hand, wrist, etc.). In response to the body thickness signal from thickness measuring system 22 and the operator selections, technic factor selector 24 calculates and displays the measured anatomical thickness and the suggested mA, KV and mAs for the forthcoming exposure. The operator can modify those suggested values by manually raising or lowering them, or accept them as they are. Technic factor selector 24 provides a respective control signal for each of the automatically selected (and possibly manually modified) technic factors, including a KV control signal indicative of the selected KV. As described in greater detail below, this KV control signal is supplied to relay control 26 which automatically sets the secondary voltage of a transformer 28 by controlling a relay network 30 to connect secondary windings of transformer 28 in a series circuit which energizes the primary winding of HVT 32 (high voltage transformer) at an appropriate voltage to cause the secondary winding of HVT 32 to in turn energize x-ray source 16 at the desired KV.

Transformer 28 has a primary winding connected to line voltage, e.g. nominally at 220 VAC, and a number of secondary windings which can be selectively connected into a series circuit by relay network 30. The turn ratios of the respective secondary windings of transformer 28 are selected such that the respective voltages across the individual winding can add up to any one of a great number of desired levels, and can thus approximate the voltage needed to energize HVT 32 in order to enable HVT 32 to in turn energize x-ray source 16 at the KV selected by technic factor selector 24 (or manually changed by the operator). For example, in a preferred embodiment six secondary windings are used in transformer 28. For a nominal 220 VAC line voltage, the voltages across the respective secondary windings are 1.9V, 3.8V, 7.6V, 15.3V, 30.6V and 61.2V. These secondary windings of transformer 28 can be connected in any desired series combination under the control of respective pairs of relays in relay network 30.

Figure 2:
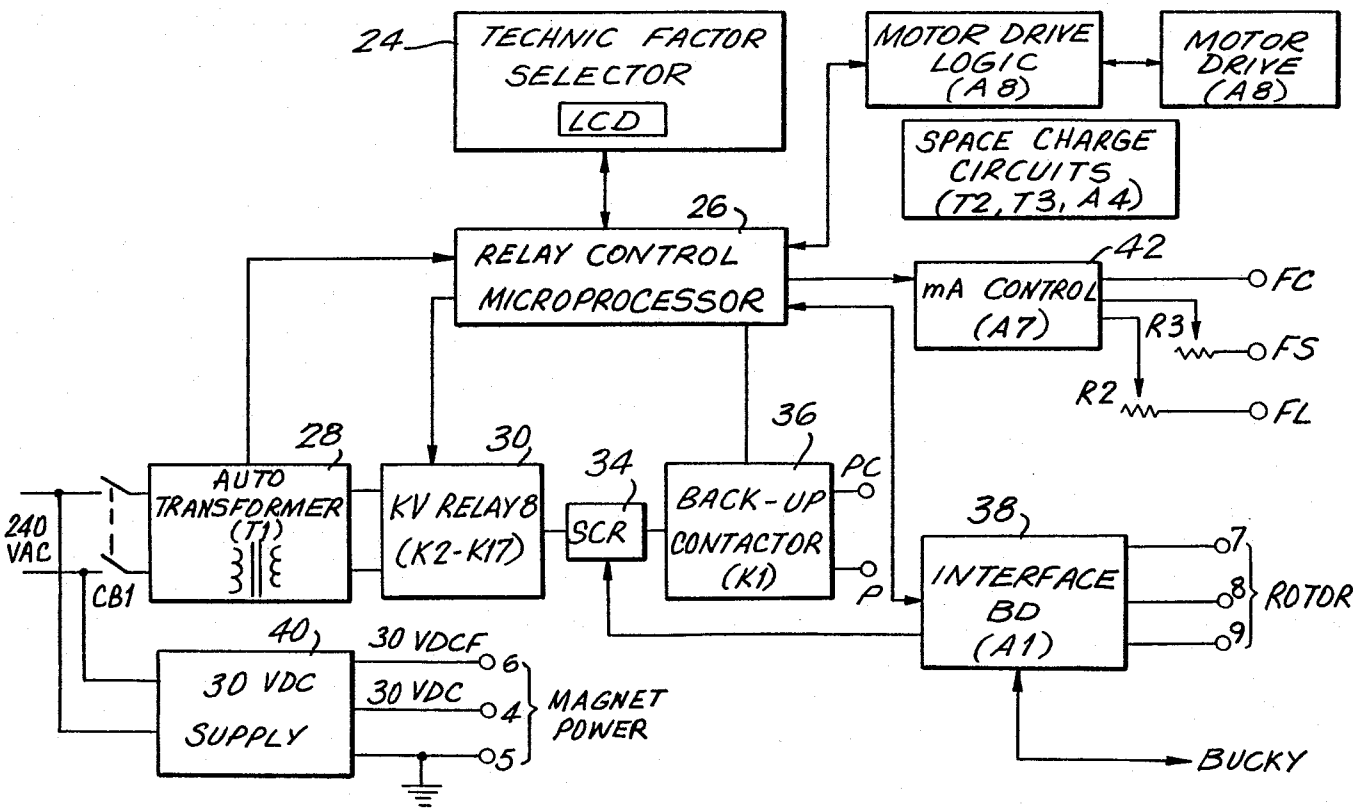
FIG. 2 is a schematic diagram of a circuit illustrating a feature of the invention.

Referring to FIG. 2, technic factor selector 24 supplies relay control 26 with control signals including the KV control signal. Relay control 26, which can be implemented by way of a programmed microprocessor, in turn opens and closes relays in relay network 30 in accordance with, for example, a look-up table LUT which is stored in relay control 26. The LUT has a respective 16-bit digital sequence for each value of the KV control signal which may be supplied from technic factor selector 24. Relay control 26 opens or closes relays K2–K17 (described in more detail below) of relay network 30 in accordance with this 16-bit binary sequence, to thereby combine the desired secondary windings of transformer 28 in a series circuit, and to supply the voltage across this series circuit to outputs P and PC (which go to the terminals of the primary winding of HVT 32), through an SCR 34 and a back-up contactor 36 (which also is controlled by an output from relay control 26). SCR 34 is controlled by interface board 38, which is a part of a safety interlock system. Relay control 26 also exchanges control signals with other parts of the system, such as mA control 42, and other elements.

Figure 3:
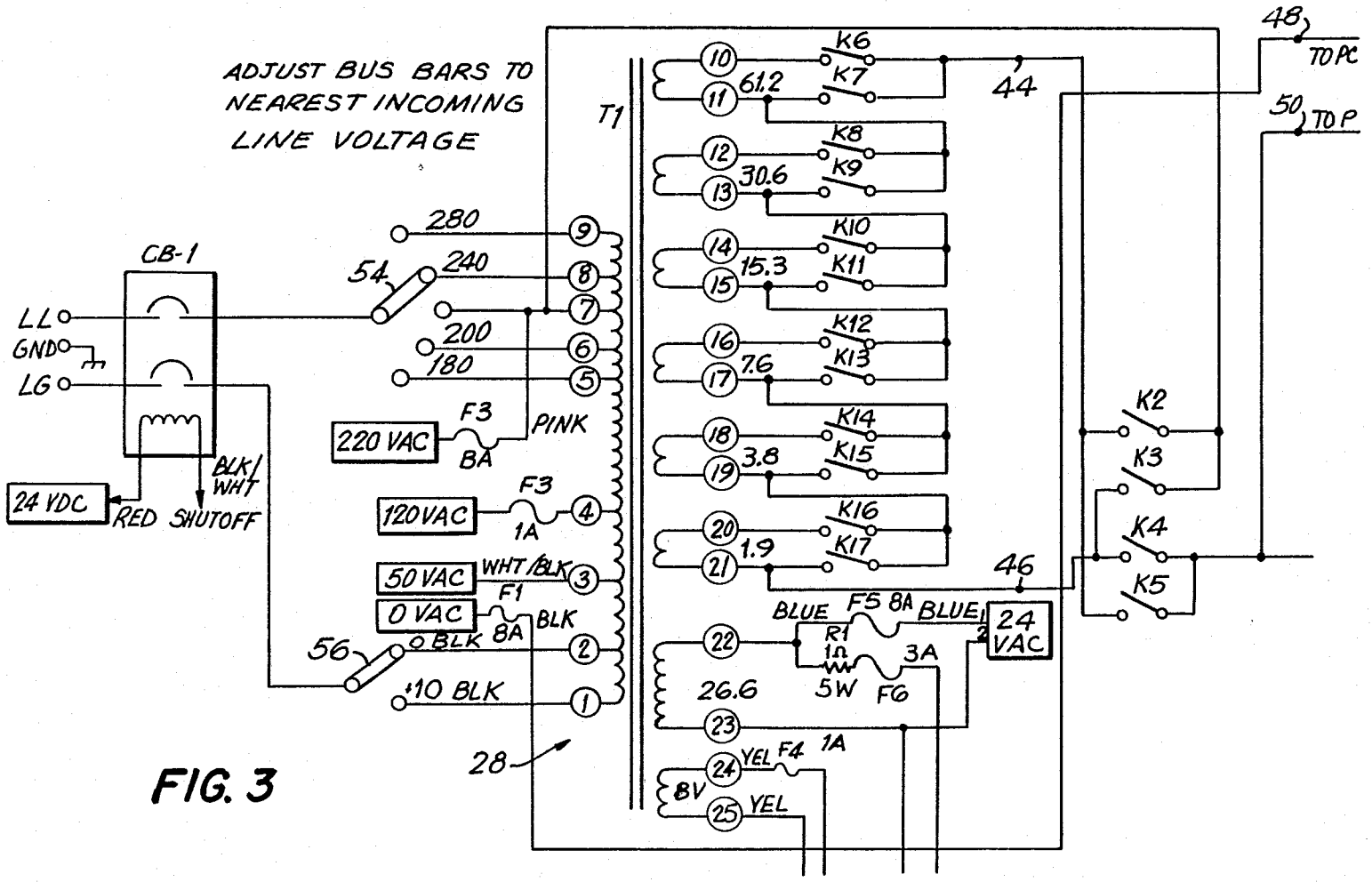
FIG. 3 is a block diagram of a part of the system of FIG. 1.

Referring to FIG. 3, transformer 28 can be a transformer having a primary winding as illustrated and six secondary windings which are connected to relays K6–K17 as shown. For a nominal 220 VAC across the primary winding of transformer 28, the voltages (AC) across these six secondary windings are as shown in FIG. 3. Two other secondary windings are used to derive voltage outputs powering other parts of the system. The six secondary windings connected to relays K6–K17 can be connected thereby into a series circuit between point 44 and point 46, and the voltage across this series circuit, and the line voltage, are fed to relays K2–K5, which also are a part of relay network 30 and also are controlled by relay control 26. The output of relays K2–K5 goes to point P and point PC, which feed to HVT 32 one of (i) the voltage across the series circuit between point 44 and point 46, (ii) the voltage between point 44 and point 46 added to the line voltage, or (iii) the voltage between point 44 and point 46 subtracted from the line voltage, to thereby energize the primary winding of HVT 32 with power whose voltage is at the desired level in the range between 100 and 340 VAC. In one exemplary embodiment, HVT 32 has a 500:1 turn ratio, so that 200 VAC supplied across terminals and PC gives 100 KV at the secondary of HVT 32.

For example, if relays K6–K17 are controlled such that only the secondary winding of transformer 28 which has a 30.6 VAC output is connected in the series circuit across point 44 and point 46, and relays K2–K5 are controlled such that this voltage is subtracted from the 220 VAC line voltage, the voltage across point 48 and point 50 is about 190 VAC (189.4 VAC) and, for a 500:1 turn ratio at HVT 32, the secondary winding of HVT 32 energizes x-ray source 16 at about 95 KV (nominally 94.7 KV).

Figure 4:
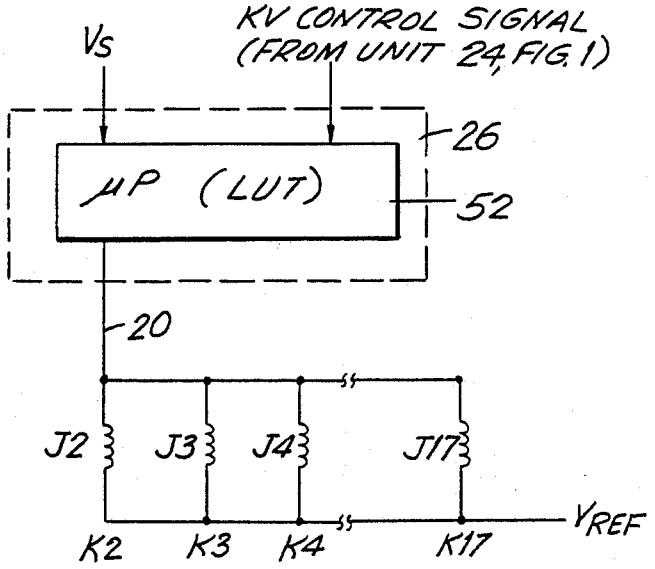
FIG. 4 is a partly block and partly schematic diagram of a portion of the system of FIG. 1.

As seen in FIG. 4, relay control 26 can comprise a microprocessor 52 which contains a look-up table LUT and is responsive to a signal (e.g. digital) from technic factor selector 24 to output a respective binary sequence which selectively energizes coils J2–J17 of relays K2–K17 to cause them to connect the appropriate secondary windings of transformer 28 into the series circuit between point 44 and point 46. For example, if 61.2 volts is the required voltage between point 44 and point 46, coils J6 and the odd-numbered coils J9–J17 are energized to close the contacts of the respective relays K6 and the odd-numbered ones of relays K9–K17, while all other coils in the sequence J6–J17 are energized to keep their respective relays open. Similarly, if the same voltage is to be applied to point 48 and point 50, coils J2 and J4 are energized to keep relays K2 and K4 closed and coils J3 and J5 are energized to keep relays K3 and K5 open.

To calibrate and set up the system with respect to the automatic setting of KV, the line voltage is measured (with a conventional voltmeter) and bus bar 54 (FIG. 3) is set to the shown terminal labelled with the nearest value. A bus bar 56 can be set to one of the two shown terminals if needed to better approximate the measured line voltage. For example, if the measured line voltage is 210 VAC, then bus bar 54 is set to the terminal labelled 200 and bus bar 56 to the terminal labelled +10. This gives an approximate calibration by selecting the number of turns in the primary winding of transformer 28 which would approximate the desired KV at x-ray source 16 in view of the actual line voltage. To calibrate more accurately, in a calibration mode the actual KV is measured at x-ray source 16 for several different KV levels with an instrument such as a Dynalyzer System, and the measurements are stored in the memory of mircoprocessor 52 and are used in a calibration procedure in which the system calculates the turn ratios of transformer 28 required in view of the measured KV in order to arrive at the desired KV levels, and the reading procedure for the look-up table in microprocessor 52 is adjusted accordingly.

Figure 5:
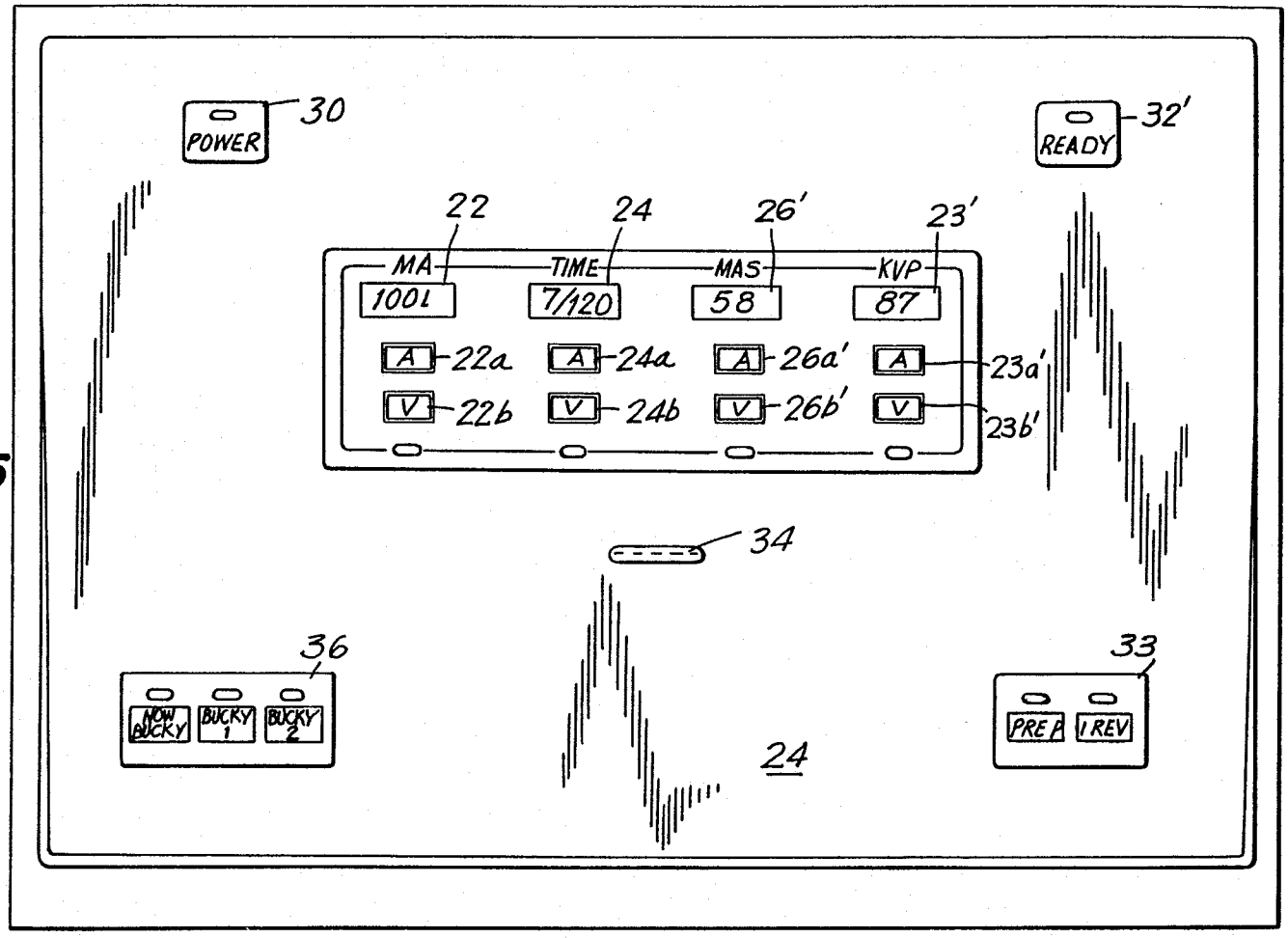
FIG. 5 illustrates an x-ray control panel which forms a part an embodiment of the invention.

In the system described above the KV control signal is derived on the basis of an automatic measurement of anatomical body thickness. While this can be advantageous, at least in some circumstances, it has been found in accordance with the invention disclosed in said parent application that significant other advantages accrue when the operator selects the KV and the mAs on a control panel such as illustrated in FIG. 5 and fully disclosed in said parent application (which is incorporated by reference herein). In particular, the operator selects the desired mAs setting by means of buttons 26*a*′ and 26*b*′ and the desired KV by means of buttons 28*a*′ and 28*b*′, and the system thereafter automatically selects the remaining technic factors and automatically supplies x-ray tube 16 with power at the correct KV. To this end, the control panel illustrated in FIG. 5 serves as technic factor selector 24, and provides the selected KV control signal to unit 26. As described above, the system thereafter proceeds to form the appropriate series circuit of secondary windings of transformer 28 and to thereby cause HVT 30 to automatically supply x-ray tube 16 with power at the correct KV.

We claim:

1. An x-ray machine comprising:

an image receptor, a support for a body, and an x-ray source energizable to irradiate the body with x-rays during an exposure interval to thereby form on the receptor an x-ray image of the body;

technic factor selection means for selecting technic factors, including operator-controlled means for selecting KV, and for providing control signals indicative of the selection, including a KV control signal indicative of the selected KV;

a first transformer having a primary winding connected across line voltage and a plurality of secondary windings and relays which selectively connect respective secondary windings into a series circuit having a secondary voltage thereacross;

a second transformer having a primary winding connected to be energized by said secondary voltage and a secondary winding connected to energize the x-ray source at a KV determined by sad secondary voltage;

relay control means responsive to the control signal indicative of the selected KV to cause said relays to connect into said series circuit those secondary windings which collectively give a secondary voltage corresponding to the selected KV, and to thereby cause said second transformer to power the x-ray source at the selected KV.

2. An x-ray machine as in claim 1 in which the secondary windings of the first transformer have an output voltages which are in substantially a binary sequence, and wherein the control means includes a microprocessor which provides a binary signal and means for opening and closing said relays in accordance with respective bits of said binary signal, wherein a selected secondary voltage can be approximated in accordance with said binary signal from the relay control means to the relays.

3. An x-ray machine as in claim 2 in which the relay control means includes a microprocessor storing a look-up table containing a respective binary sequence for each of selected levels of the KV control signals and means for reading out the sequence in response to the receipt of a KV control signal for use of the sequence in controlling said relays.

4. An x-ray machine as in claim 1 including a switching circuit connected between line voltage and said primary winding of the first transformer, and wherein said primary winding has a number or taps and said switching circuit selectively connects said line voltage to selected one or more taps depending on the voltage level of the line voltage.

5. An x-ray machine as in claim 1 in which the secondary winding of said first transformer have an output voltages which are in substantially a binary sequence.

6. An x-ray machine as in claim 1 in which the secondary windings of said first transformer form a sequence of windings S1, S2, S3, . . . in which the output voltage of the winding S2 is about twice that of S1, the output voltage of S3 is about twice that of S2, and so on for the entire sequence of secondary windings of the first transformer.

7. A method of imaging a body with an x-ray machine comprising the steps of:

providing an image receptor, a support for a body, and an x-ray source energizable to irradiate the body with x-rays during an exposure interval to thereby form on the receptor an x-ray image of the body;

providing control signals indicative of the selection of technic factors, including a KV control which is manually selected by an operator of the x-ray machine and is indicative of the selected KV;

connecting the primary winding of a first transformer across line voltage and selectively connecting respective secondary windings of the first transformer through relays into a series circuit having a secondary voltage thereacross;

energizing the primary winding of a second transformer with said secondary voltage and energizing an x-ray source with the power at the voltage which is a the secondary winding of the second transformer, to thereby cause the source to irradiate a body on a support with x-rays during an exposure interval and thereby form, on an x-ray receptor, an x-ray image of the body;

wherein the KV control signal is used to generate a binary control sequence driving said relays which selectively connect the secondary windings of the first transformer into said series circuit.

8. An x-ray machine including means for the manual selection of an mAs setting by an operator of the machine and means for automatically setting other technic factors except KV in response to the mAs set by the operator, and including an x-ray tube, a first transformer with separate secondary windings, means for the manual selection of a KV control signal by an operator of the machine, a plurality of relays and means for selectively including selected ones of said secondary windings in a series circuit through controlling said relays by a binary sequence in response to the KV control signal which is manually selected by an operator of the x-ray machine, and a second transformer having a primary winding connected across said series circuit and a secondary winding connected to the x-ray tube to supply power thereto at a KV determined by the voltage across said series circuit.

9. An x-ray machine as in claim 8 in which said first transformer has a primary winding which has a first side and a second side and a plurality of first taps at said first side thereof, each tap corresponding to a respective different AC power supply voltage level, and wherein said machine includes a first switching circuit for connecting a selected one of said first taps in the primary winding of the first transformer to a first lead on the AC power supply depending on the level of the power supply voltage.

10. An x-ray machine as in claim 9 in which said primary winding of the first transformer includes a plurality of second taps at said second side thereof, and wherein said machine includes as second switching circuit for connecting a selected one of said second taps to a second lead of an AC power supply depending on the level of the power supply voltage.

* * * * *